US011000776B1

(12) United States Patent
Gutierrez et al.

(10) Patent No.: US 11,000,776 B1
(45) Date of Patent: May 11, 2021

(54) SPECIAL EFFECTS SYSTEM PROVIDING A CEILING SABER CUT

(71) Applicant: Disney Enterprises, Inc., Burbank, CA (US)

(72) Inventors: Jose A. Gutierrez, Burbank, CA (US); Daniel M. Joseph, Orlando, FL (US); Sean Paul Torres, Santa Clarita, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 16/827,423

(22) Filed: Mar. 23, 2020

(51) Int. Cl.
*A63J 5/02* (2006.01)
*A63G 31/00* (2006.01)
*E04H 3/24* (2006.01)

(52) U.S. Cl.
CPC ..... *A63J 5/023* (2013.01); *A63J 5/021* (2013.01); *A63J 5/025* (2013.01); *E04H 3/24* (2013.01)

(58) Field of Classification Search
USPC ..... 472/59–61; 434/234
See application file for complete search history.

(56) References Cited

U.S. PATENT DOCUMENTS 6,077,078 A * 6/2000 Alet ..... F16M 11/046 434/29
6,665,985 B1 * 12/2003 Hennes ..... E04H 3/22 352/69

* cited by examiner

*Primary Examiner* — Kien T Nguyen
(74) *Attorney, Agent, or Firm* — Snell & Wilmer L.L.P.; Kent A. Lembke

(57) ABSTRACT

A special effects system to provide the effect or illusion of a surface of a set (such as a ceiling, sidewall, floor, or the like) being penetrated and cut by a physical prop (e.g., a tool or weapon). In some preferred embodiments, the physical prop takes on the appearance of a glowing or hot elongated rod similar to the blade of an energy sword or light saber as found in entertainment media. The system is configured to provide the illusion, in these cases, that a circular groove or slot is being formed as the hot blade burns through the material of the surface of the set/scene. Additional effects add to the believability of this illusion including the up and down sawing movement of the physical prob through the slot, appearance of smoke with shadows near the cutting regions, and bright sparkling lighting at leading edge of slot.

20 Claims, 10 Drawing Sheets

SPECIAL EFFECTS SYSTEM PROVIDING A CEILING SABER CUT

BACKGROUND

1. Field of the Description

The present description relates, in general, to special effects and display systems designed to provide effects in a repeatable manner. More particularly, the present description relates to a special effects system adapted to provide the effect of a physical or three-dimensional (3D) prop, such as an energy sword or light saber, cutting through a ceiling, with the special effect or illusion viewable by an observer in a known location or in a viewing space nearby to the set or space defined in part by the ceiling.

2. Relevant Background

In theme and amusement parks and other settings, there are many situations where it is desirable to provide a special effect or illusion to entertain and excite visitors or observers. Further, each of these special effects or illusions needs to be provided over-and-over or in a repeated manner over the day and, often, the time between presenting the special effect or illusion is relatively short (e.g., a minute or less). These design requirements can present design challenges to those in the special effects industry beyond simply generating an effect successfully and in a manner that is believable to the observer. For example, theme and amusement park rides and attractions often include special effects that need to be produced with high quality to be believed and enjoyed by ride and attraction participants and in a quickly repeatable manner to support the flow of participants through such rides and attractions.

A particularly challenging effect is how to create a special effect in which a physical or 3D prop, such as a light saber or glowing energy sword, appears to penetrate through a solid ceiling in a scene and then to repair the ceiling to repeat the illusion for a next group of observers. This may be desirable for a space along an amusement or theme park ride, in an entertainment attraction, and in a theatrical setting as well as in other settings.

Particularly, there is a demand for this special effect to be provided such that the physical prop appears to cut down into the room or set space from above. Still further, there is a desire for the prop to have a glowing or "hot" extension that appears to burn through the ceiling such as straight down from above so that it is clearly visible to a viewer (e.g., with 1 to 2 feet or more extending out from the ceiling during the cutting motion). Next, in addition to simple penetration, it may be desirable for the physical prop to begin to cut a groove into the ceiling (e.g., to cut the ceiling material horizontally) using an up and down sawing motion (e.g., in an arc shape of some desired diameter such as 2 to 4 feet or the like but often only half to three quarter of a full circle). The physical prop would then need to return to its starting position, and the ceiling would need to magically repair itself in a matter of a few seconds to be ready to repeat the operations of the special effects system. This would need to happen over and over, such as every 20 to 30 seconds or the like in a ride or attraction application, somewhere between 10 and 17 hours every day.

There does not presently exist any special effects system that can provide an optical illusion of a physical prop cutting through a solid surface such as a room's ceiling. Hence, there remains a need for a new special effects system, and method implemented by the system's operation, that is operable to provide a ceiling cut as may be provided by an actor or character using an energy sword to make an opening in a ceiling that they can drop through.

SUMMARY

With the above design challenges in mind, a special effects system was created to provide the effect or illusion of a surface of a set (such as a ceiling, sidewall, floor, or the like) being penetrated and cut by a physical prop (e.g., a tool or weapon). In some preferred embodiments, the physical prop takes on the appearance of a glowing or hot elongated rod similar to the blade of an energy sword or light saber as found in entertainment media. The system is configured to provide the illusion, in these cases, that a circular groove or slot is being formed as the hot blade burns through the material of the surface of the set/scene.

Additional effects add to the believability of this illusion including the up and down sawing movement of the physical prop through the newly "cut" slot, appearance of smoke with shadows near the cutting regions, and bright sparkling lighting at the leading edge of slot similar to that expected if an extremely hot rod was cutting through the set's surface. The system is further configured to "repair" the set's surface in seconds and reset in preparation of providing the illusion or effect for a next group of observers (e.g., riders of a vehicle in a park ride or attraction).

More particularly, a system is provided that is adapted to create a surface cutting special effect. The system includes a physical set with a surface defining a space that is adjacent to a viewing space, and the surface includes a plurality of panels each with a projection surface facing the space. The system also includes a viewing window or hole provided in the surface in place of one of the panels (the surface to be cut is missing one of the panels). The system further includes a disk with a first surface facing toward the space and with a second surface facing away from the space, with the disk being positioned to be parallel to a plane containing the panels and a small distance (such as less than 0.25 inches) away from back sides of the panels. The system also includes a slot extending through the disk from the first surface to the second surface. A motor is provided with an output coupled to a center portion of the disk on the second surface of the disk, and the motor is operable to rotate the disk about its center from a first position with a portion of the disk free of the slot being positioned over the viewing window to a second position with a portion of the disk containing the slot being positioned over the viewing window. Additionally, the system includes a pivoting physical prop assembly with a drive mechanism mounted to the second surface of the disk, with a support arm coupled at a first end to the drive mechanism, and with a physical prop coupled to a second end of the support arm. Also, the physical prop has an elongated body, and the support arm is driven during operations of the drive mechanism to pivot through a travel path that causes the body of the physical prop to move in and out of the slot to extend from the first surface a predefined distance.

In these or other embodiments of the system, the body of the physical prop houses a lighting assembly operating during the operating time period to illuminate the body, and the physical prop further includes a drive element operating during the operating time period to rotate the body about a longitudinal axis. In such cases, the drive element may include an electric motor, and the body includes: (a) a central tube coupled to the electric motor for rotation about the longitudinal axis; (b) at least one strip of light emitting diodes (LEDs) extending along an outer surface of the central tube; and (c) a layer of diffusing material over the at least one strip of LEDs.

In these or other implementations, the disk is circular in shape, and the slot is semicircular in shape. Then, the disk has an outer diameter selected such that the first surface of the disk covers an entire area of the viewing window with the disk in the first position and in the second position. Further, the disk further may include a wall on the second surface of the disk that extends along the periphery of the slot and outward from the second surface a distance of at least 1 inch.

DETAILED DESCRIPTION

Figure 1:
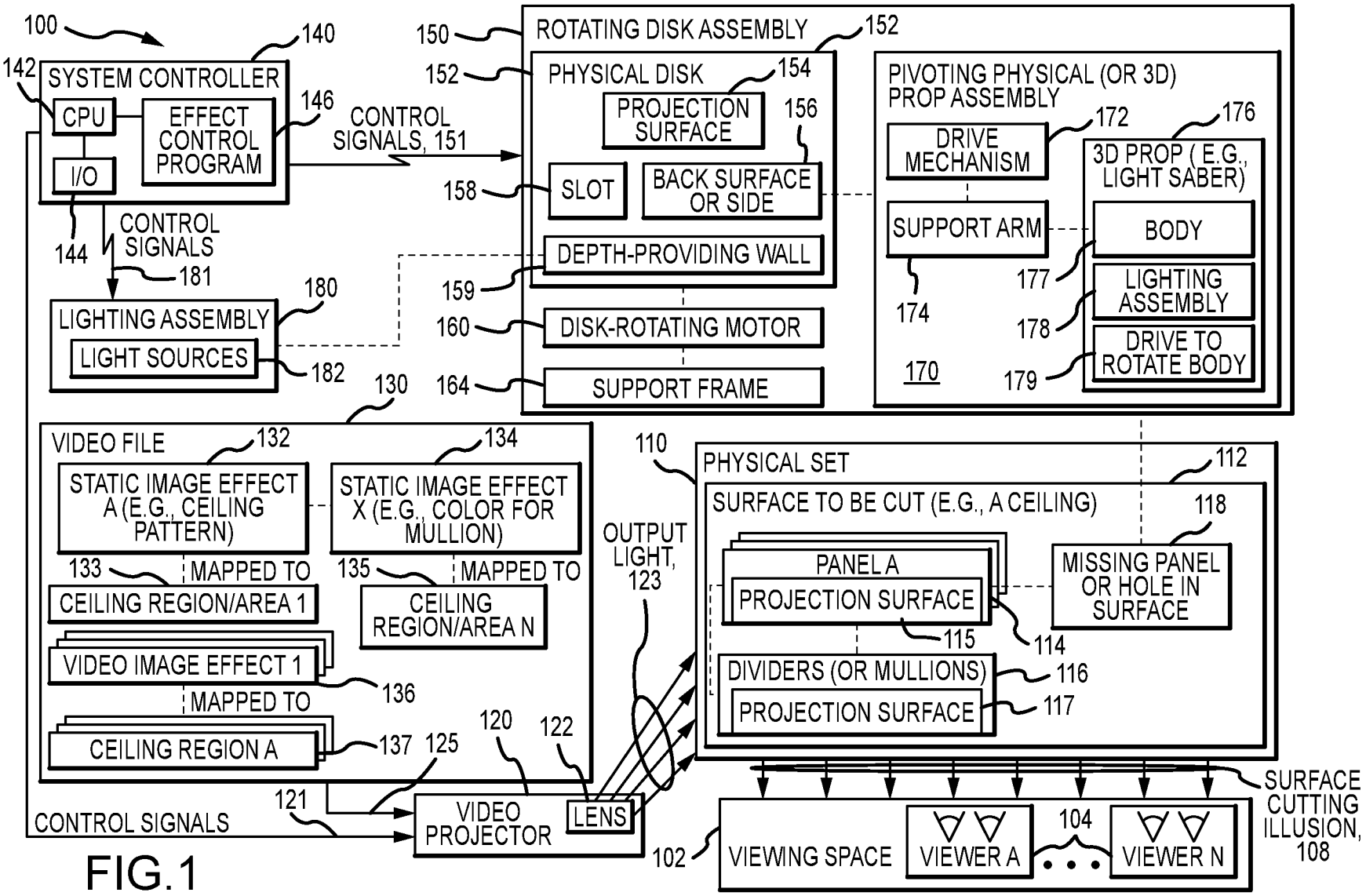
FIG. 1 is a functional block drawing of a special effects system of the present description that is adapted to produce a ceiling cutting illusion or effect for viewers/observers in a viewing space.

In some embodiments of the system, the motor and drive mechanisms are operated concurrently (such as by a system controller running a control program and transmitting synchronizing control signals). In these and other embodiments, the system also includes a video projector projecting light providing matching static images onto the first surface of the disk and onto the projection surfaces of the panels, and the static images are media mapped to the locations of the first surface of the disk and to the projection surfaces of the panels (e.g., are artistic patterns expected for ceiling surfaces or the like). Further, the video projector is operated to project light providing dynamic images onto the first surface of the disk that are media mapped to locations of the slot during operations of the motor to rotate the disk. For example, the dynamic images may include smoke with drop shadows, flames, or glowing areas. In some implementations, the system includes a lighting assembly with light sources positioned in or near a leading edge of the slot and adapted to output light on an intermittent basis, whereby the leading edge is illuminated with flashes of light.

Prior to turning to the figures and particular exemplary implementations, it may be useful to the reader to provide a brief overview of the new special effects system created to achieve the ceiling saber cutting effect. The effect/illusion was accomplished by using a round disk with a curved slot in it, e.g., a semicircular slot such as one third to two thirds of a circle. The slot was given raised walls along its periphery on the back side or surface of the disk (the side opposite the viewing space) to provide depth to the "cut" slot. In the system, there is also a ceiling or other surface that will be cut, and this ceiling or surface is formed with a plurality of panels and mullions or dividers therebetween. To provide a viewing window or hole to the disk's bottom or projection surface, all the panels are present except for one (or more).

In the assembled system, the disk is supported so that it is parallel to the ceiling panels and sits very close to their back surfaces or just above the ceiling. Significantly, at the start of system operations or prior to initiation of the effect/illusion, the disk is rotated into a first or starting position in which its solid portion (i.e., the portion without the slot) covers the viewing window or hole in the ceiling (e.g., with its solid projection or bottom surface facing the space below the ceiling and viewing space with its observers and also the video projector). The disk is sized (with a large enough outer diameter (OD)) and strategically positioned in the system such that the half of the disk that does not have the curved slot in it covers the open panel area completely so the observer cannot see above the ceiling or spot presence and/or use of the rotating disk.

The disk, in this first or starting position, appears to be a normal ceiling panel when viewed from below. There is a motor mounted with its driven output shaft affixed to the center of the disk and supported via a support frame or truss from above so that the motor and disk are hanging above the back side of the ceiling panels and mullions. This motor is run to turn the disk about its center axis, and this rotation, from the first or starting position toward a second or ending position, causes the previously hidden slot in the disk to rotate into view via the viewing window or hole in the ceiling (where the panel is missing from the ceiling).

A pivoting physical prop assembly is included in the special effects system and is mounted on the back or top side of the disk (opposite the viewing space) so that it rotates with the disk, and its physical prop (e.g., a light saber or the like) is supported so that it has an end of its body or "blade" in the slot at the leading edge of the slot. The saber or other prop protrudes through the "cut" slot at the leading edge of the slot when the pivoting physical prop assembly pivots the prop body from an up or retracted position to a down or extended position (during the sawing motion).

The saber or other prop is mounted to an end of a support arm (e.g., at its hilt or an end of the body opposite the end that extends into and outward from the cut slot), and this arm is pivotally supported at its opposite end to a pivot joint and drive mechanism (e.g., an electric motor) that are affixed to the top or back side of the disk. The drive mechanism is mounted at the pivot and is programmed to move in a slow back and forth motion, and this motion teeters the support arm along with the attached physical prop (e.g., light saber) up and down (e.g., several to many inches to suit a desired amount of extension of the prop into the space observed by an observer during the effect/illusion) as the disk is rotated from the first to the second position (from the starting to the end position).

In brief, a special effects system is provided that creates a realistic effect or illusion that a surface of a set or space is being penetrated and then cut through while an observer in a nearby space (such as a vehicle of theme park ride or attraction) looks on. Particularly, there are tools or weapons that are used by many characters of movie and other media that are elongated and glowing with energy or appear hot such as energy swords or light sabers, and the special effects system can be configured to create the illusion or effect that a physical or 3D version of these tools or weapons is being used by someone behind the surface to get into the space seen by the observers. A circular slot appears to be cut by the weapon or tool, and the observer even sees sparks/fire and/or smoke with shadows near by the slot while a portion of the tool or weapon extends through the slot in a sawing motion (e.g., an up and down motion if the surface is a ceiling in the set space or room).

In addition to the surface detail, the video projector may also be used to project media (dynamic imagery) of a glowing edge and smoke with a drop shadow all along the outer edge of the slot as it moves. This makes it appear as though the saber is burning through the material of the disk. Further, a lighting assembly can be included with light sources (e.g., light emitting diodes (LEDs)) at or near the leading edge or about the periphery of the slot that are caused to flicker or twinkle to enhance the live cutting effect.

To disguise the fact that the disk is rotating, the special effects system includes a video projector to project media from below onto the ceiling/surface panels, mullions, and the exposed or projection surface of the disk. The media or projected images may include static image effects such as of a still or static pattern onto the projection surfaces of the panels and the disk and a simple color onto the mullions' projection surfaces. As the disk rotates, the projected media is still or static, which fools the eye of the observer into thinking that the surface area is not moving. When viewed from below (or in the space defined by the surface including the panels and disk), the protruding physical prop (e.g., light saber) at the leading edge of the cut/slot with its up and down (or in and out) motion and the gradual reveal of the slot as the disk rotates together with the projected static media creates the illusion that the physical prop is actually cutting a curved slot in what appears to the observer to be a normal surface (e.g., a panel of a ceiling of a space or room adjacent the viewing space).

FIG. 1 is a functional block drawing of a special effects system 100 of the present description that is adapted to produce a ceiling cutting illusion or effect 108 for viewers/observers 104 located in a viewing space 102. The viewing space 102 is located adjacent and proximate (e.g., within 3 to 12 feet or the like) of a physical set 110, which is configured to define a stage or set space with one or more surfaces such as a floor/platform, one to four or more walls, and a ceiling. The physical set 110 includes a surface 112 to be "cut" as part of the illusion or effect 108. This may be any of the surfaces (horizontal or vertical), and the examples provided herein show the surface 112 to be cut to be a ceiling of a space defined by the physical set 110 as this is desirable to replicate a scene(s) of one or more popular movies where a character uses a tool or weapon to enter a space through the ceiling.

The surface 112 is presented to the viewers 104 through a combination of panels 114 and dividers or mullions 116 between pairs of side-by-side panels 114. The panels 114 may take a variety of shapes and sizes with some implementations using rectangular panels that are 2 to 4 feet in width and 3 to 6 feet in length. Each panel 114 has a surface 115 that faces the space or room defined by the physical set 110 and that is visible to the viewers 104 in the viewing space 102, and this surface 115 may be considered a projection surface as it receives images in light 123 from a video projector 120. These surfaces 115 of the panels 114 typically are all colored (e.g., painted) a similar color (such as gray) and configured for use as projection screens/surfaces. Similarly, each of the mullions 116 includes a projection surface 117 facing into the space/room defined by the physical set 110 and visible by the viewers 104 in viewing space 102 during the illusion/effect 108. These surfaces 117 may also be colored or prepped for projection with light 123 from the video projector 120 or may be left in a metallic/reflective state in some cases. Significantly, to achieve the surface cutting illusion 108 during operations of the system 100, the surface 112 to be cut further includes a viewing window or portal in the form of one or more missing panels or holes 118.

With the missing panel or hole 118 in the surface 112, the viewers 104 in viewing space 102 are able to see behind the surface 112 (e.g., into a space above the surface 112 when it is a horizontal ceiling). However, instead of a direct line of sight to this hidden space, the system 100 includes a rotating disk assembly 150. This assembly 150 includes a physical disk 152 that has a planar and, typically, circular body with an outer diameter (OD) large enough to fully cover the hole or window 118 provided by the missing panel when it is placed parallel to and over the hole/window 118. More typically, disk 152 has an OD that is large enough that half or less of the disk's body will fully cover the hole/window 118 in the surface 112 to be cut (e.g., 6 foot or more in OD). The disk 152 is arranged parallel to the panels 114 with a first or projection surface/side 154 facing the hole/window 118 and a second or back surface/side 156 facing away from panels 114. The disk 152 is typically spaced apart only a small distance (e.g., 0.125 to 0.25 inches apart or the like) from the back surfaces of the panels 114.

As will be explained in more detail below, the disk 152 further includes a slot 158 through its body used to show where it has been physically cut or fully penetrated during the illusion 108. This provides a pathway for a physical or 3D prop 176 to extend through the disk 152 during operations of the system 100, and it allows the viewers 104 to see through the disk 152. A wall 159 is provided about the periphery of the slot 158 on the back surface or side 156 of the disk 152 to provide depth to the cut and/or disk 152 during the effect 108, and its interior surfaces may be a dark color such as black or even absolute black and have a height of 1 to 3 inches or more. The slot 158 may have a variety of shapes and lengths, with its width typically being a small amount (e.g., 0.125 to 0.25 inches) more than the outer dimensions of the physical prop body 177. In some implementations, the slot 158 is curved, and, in some preferred cases, the slot 158 is a semi-circular arc with a center coinciding with the center of the disk 152. Particularly, the slot 158 may be one third to three quarters or more of a full circle, and, in practice, the slot 158 is provided between the center of the disk 158 and the outer edge of the disk 158 (e.g., at about half the radius of the disk 158 from the center of the disk 158).

The assembly 150 further includes a motor 160 for rotating the disk 152 about its center during the illusion 108, and the motor 160 is coupled to the center of the disk 152 on the back surface 156 and acts to support the disk 152 over the panels 114 and the missing panel/hole 118. The motor 160, in turn, is supported above or relative to the surface 112 to be cut with a support frame 164. During operations of the system 100, the motor 160 rotates the disk 152 from a first or starting position in which the slot 158 is spaced apart from the hole 118 and behind one or more of the panels 114 and/or dividers 116 to a second or ending position in which all or a portion of the slot 158 is over the hole/window 118 and visible by the viewers 104 in the viewing space 102. During the rotation from the first to the second position, the slot 158 appears to be started and then to grow in length, and the speed of rotation may be in the range of 1 to 10 RPM or more and is chosen to suit the desired artistic goals for the effect or illusion 108.

The rotating disk assembly 150 further includes a pivoting physical or 3D prop assembly 170. This assembly 170 includes a drive mechanism 172, a support arm 174, and a physical prop 176. The prop 176 includes a body 177 that is shaped and sized to replicate a tool or weapon such as a saw, a blade, an energy sword or light saber, or the like that would be used by a character to cut through a surface. The body 177, for example, may be cylindrical in shape and be two to six feet or more in length. The body 177 is attached at one end (e.g., at the hilt or handle of an elongated blade of the body 177) to the support arm 174, and the support arm 174 is coupled at its other end (the end not attached to the body 177) to the drive mechanism 172.

The drive mechanism 172 is mounted onto the back surface or side 156 of the physical disk 152 such that it rotates or moves with the disk 152 during operations of the motor 160 and, significantly, with the slot 158. The body 177 is supported by the arm 174 such that a portion or extension opposite the end attached to the arm 174 is located in the slot 158 (or proximate to the slot 158). Then, during operations of the system 100 and drive mechanism 172, the arm 174 has its end coupled to the body 177 pivoted up-and-down relative to the back surface 156 of the disk 152. This arm motion causes the body 177 of the prop 176 to move from a first (or up) position in which it is barely in the slot 158 (such as in the wall 159) to a second position (or down) position in which a significant length (chosen for artistic reasons) extends outward from the slot 158 and the projection surface 154 of the disk 152 so that its up-and-down (or in-and-out) movements are easily observed by the viewers 104 in the viewing space 102 (such as with 12 to 24 inches of the body 177 (e.g., light saber) extending outward from the surface 112 when the body 177 is in the second or extended position).

In some embodiments, it is desirable for the illusion or effect 108 to be created such that the prop 176 appears to be a hot or energized blade cutting through surface 112. In these cases, a lighting assembly 178 may be provided (as discussed in more detail below for one light saber embodiment of the prop 176) in or on the body 177 and be configured to cause the body to glow and appear to be energized or hot. Further, the prop 176 may be configured to have its own motion with this motion contributing to the cutting effect or illusion 108. For example (and, again, as discussed below for a light saber embodiment of the prop 176), a drive 179 is provided in the prop 176 that is configured to rotate (or otherwise move) all or a portion of the body 177 concurrently with the operation of the lighting assembly 178 and the drive mechanism 172.

The system 100 further includes a video projector 120 with its output/lens 122 arranged or provided so that the projector's output light or media 123 is directed onto the projection surfaces 115 of the panels 114, the projection surfaces 117 of the mullions 116, and onto portions of the projection surface 154 of the disk 152 that are moved by the motor 160 to be filling or covering the hole/window 118 in the surface 112. Particularly, the video projector 120 plays or projects input 125 from a video file 130 (e.g., in response to control signals 121 from a system controller 140), which may be in locally accessible memory or data storage or provided over a wired or wireless communication network (not shown in FIG. 1 but understood by those in the art). The video file 130 includes first static image effects 132 which are mapped (using media mapping) to first regions 133 of the surface 112 and also second static image effects 134 which are mapped to second regions 135 of the surface 112.

For example, static images of an artistic pattern for a ceiling or the like may be provided in static image effects 132, and these are media mapped to locations of the projection surfaces 133 coinciding with surfaces 115 of panels 114 in the surface 112. Similarly, static images of a colored region for dividers or the like (e.g., a solid color image) may be provided in static image effects 134, and these are mapped to locations of the projection surfaces 135 coinciding with surfaces 117 of mullions 116 in the surface 112. The projector 120 is operated concurrently with the operation of the disk-rotating motor 160 to rotate the disk 152, and this causes the viewer 104 to perceive both the panels 114 and the projection surface 154 of the disk 152 to be static or non-moving because the imagery projected with light 123 onto them is static (and also hides the disk 152 when it is not moving and is simply blocking the window/hole 118 prior to rotation by motor 160).

The illusion or effect 108 is further enhanced by having the video projector 120 operate with input 125 from file 130 to project video or dynamic image effects 136 that are mapped to portions of the ceiling 137. Particularly, the dynamic image effects 136 may include moving imagery that furthers the belief by the viewers 104 that the slot 158 is being created in the present by a hot or energized tool or weapon in the form of the prop 176. For example, the effects 136 may include puffs of moving smoke mapped to the projection surface 154 of the disk 152 as it is rotated by motor 160 adjacent the slot 158 (e.g., near the leading edge of the slot 158), and these puffs of smoke may also include drop shadows projected onto the projection surface 154 of the disk 152 near and "behind" each created puff/cloud of smoke. These dynamic image effects make it appear to the viewer 104 of the illusion 108 that the slot 158 is being burned by the prop body 177. Other dynamic image effects 136 may include images of flames/fire that may be mapped to the slot 158 or, more accurately, to portions of the projection surface 154 at or near edges of the slot 158 as the slot 158 is moved through the hole/window 118 during operations of the disk-rotating motor 160.

A lighting assembly 180 may also be included in the system 100 and operable in response to control signals 181 from the controller 140 to selectively illuminate portions of the physical set 110 to enhance or add to the illusion or effect 108. For example, the illusion or effect 108 may be of a hot or energized body 177 of a prop 176 cutting the slot 158 in the surface 112. In this case, light sources 182 may be provided at, in, or near the leading edge (or on trailing edges) of the slot 158, and the control signals 181 may cause the light sources 182, which may be bright white or colored LEDs, to operate to provide bright light that may flash or twinkle (be intermittent) as if the body 177 were burning the material of the disk 152 to provide the slot 158 (e.g., similar to welding or torch cutting operations).

The system 100 includes a system controller 140 with a processor 142 managing operations of input/output (I/O) devices 144 to communicate control signals 121, 151, and 181 to the video projector 120, rotating disk assembly 150, and lighting assembly 180 to initiate operations of the system 100 to provide or generate the illusion or effect 108 for viewings 104 in viewing space 102. The processor 142 may run or execute software or code (e.g., in local memory) to provide the functionality of an effect control program 146, which includes generating the control signals 121, 151, 181. The program 146 may be configured such that the operation of the video projector 120 is timed to provide the static image effects 132, 134 in the output light 123 throughout the effect 108 and to provide the dynamic image effects 136 in a time synchronized manner with the rotation of the disk 152 by the motor 160 (e.g., such that the mapping of the dynamic image effects 136 provides the images on desired portions of the projection surface 154 of the disk 152). Similarly, the program 146 is designed to synchronize operations of the drive mechanism 172, lighting assembly 178, and body-rotating drive 179 with the disk-rotating motor 160 so that operations of the prop assembly 170 is matched to the location of the slot 158 over the hole/window 118. At the end of the illusion/effect 108, the controller 140 (and its program 146) generates signals 121, 151, 181 to return to a start or first state (and/or positions) to be ready to generate a next illusion 108 for a next set of viewers 104 entering into the viewing space 102.

Figure 2:
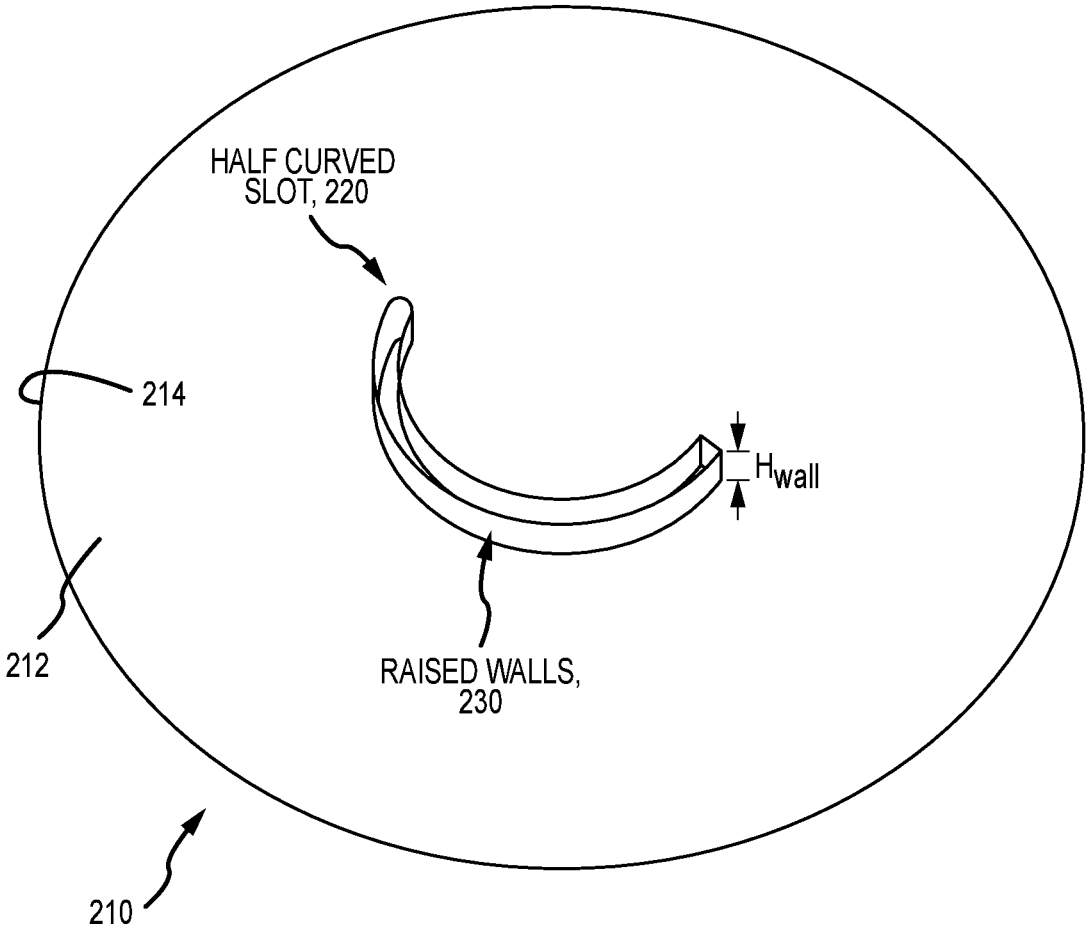
FIG. 2 is a top perspective view of a slotted disk, which may be used in a special effects system of the present description such as the system of FIG. 1, showing the top or back side/surface of the disk, the disk's slot, and a depth-providing wall about the slot.

FIG. 2 is a top perspective view of a slotted disk 210, which may be used in a special effects system of the present description such as the system 100 of FIG. 1. FIG. 2 shows the top or back side/surface 212 of the disk 210, which would be facing away from the hole/window provided by a missing panel or region of the surface to be cut (e.g., a ceiling), and the bottom or projection side/surface 214 of the disk 210 would be facing this hole or window during use of the disk 210. The disk's body is shown to include a slot 220 cut through the material of the disk 210. The slot 220 has a semi-circular shape (e.g., a half circle in this example but may be larger or smaller to practice the invention). The width of the slot 220 is chosen to be at least as large as the largest outer dimension of the body of the prop used to "cut" the slot 220 and usually with some clearance (e.g., 0.125 to 0.25 inches or more depending on the effect desired). The OD of the disk 210 (or outer dimension if not round/circular in shape) is chosen such that the disk's surface 214 wholly covers the window/hole formed by the missing panel, e.g., a 5 to 7-foot OD may be useful in many cases. Further, as shown in FIG. 2, a depth-providing wall 230 is provided that extends about the periphery of the slot 220 on the top or back surface 212 of the disk 210 with a height, $H_{Wall}$, (e.g., 1 to 3 inches or more) that provides depth to the slot 210 (beyond the thickness of the disk that may only be 1/16 to 1/4 inches with the body formed of a rigid but relatively lightweight material such as a plastic) and the inner surfaces of the wall 230 may be colored a darker color such as dark gray to absolute black or the like.

Figure 3:
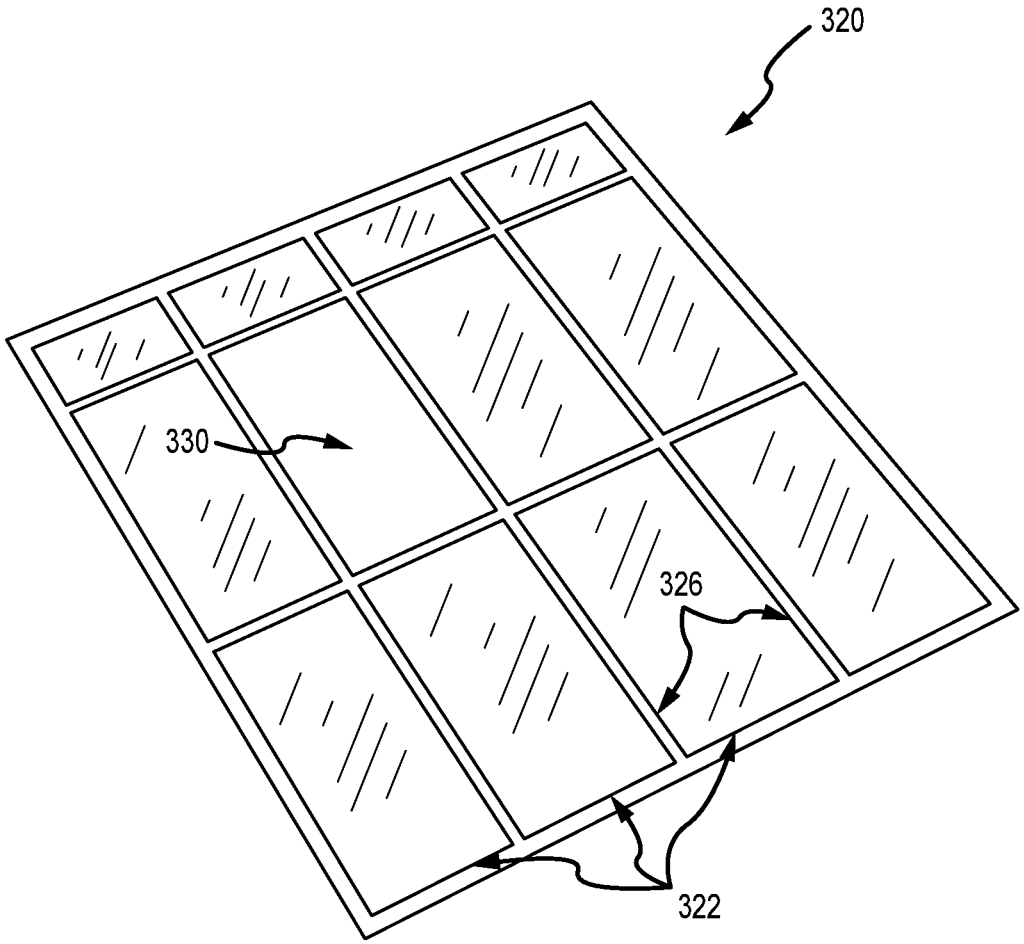
FIG. 3 illustrates a top perspective view of an exemplary surface to be cut (e.g., a ceiling or the like) in a special effects system showing its panels and dividers/mullions as well as a viewing window or hole/gap where a panel is missing or not provided.

FIG. 3 illustrates a top perspective view of an exemplary surface 320 to be cut (e.g., a ceiling or the like) in a special effects system. The surface 320 in this example is made up of panels 322 separated by mullions 326. Further, the surface 320 includes a viewing window or hole 330 formed or provided where a panel is missing or not provided or by leaving out one or more panels 322. In surface 320, the hole or window 330 is rectangular, but other shapes may be used to practice a special effects system of the present description.

Figure 4A:
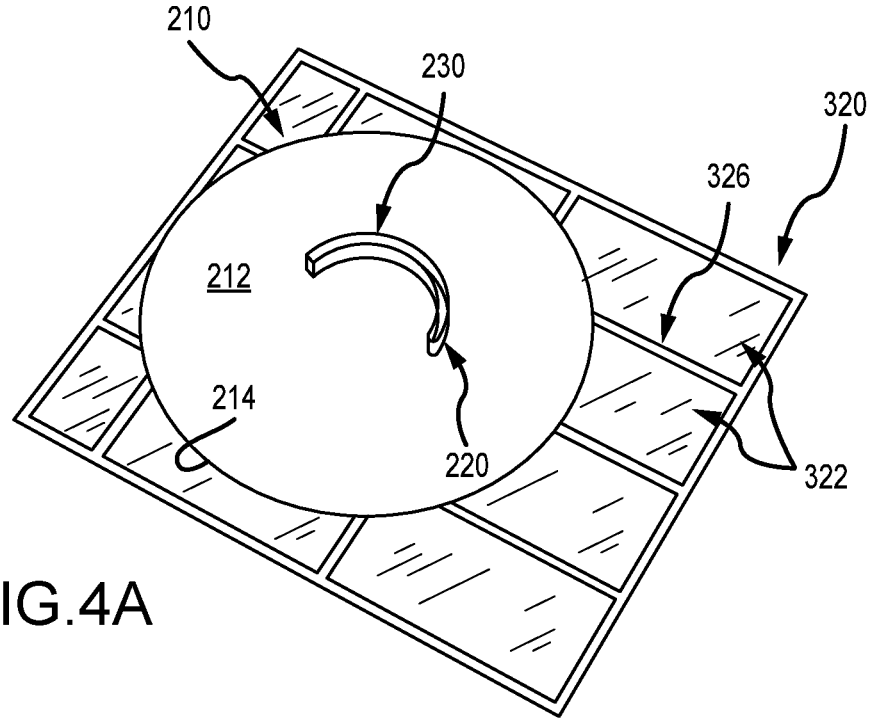
FIGS. 4A and 4B are top perspective views of a ceiling and slotted-disk assembly, conventional view and transparent-disk view respectively, with the disk in a first or starting position in with the slot positioned behind one of the physical panels of the ceiling (so existence of slot and viewing window/hole are hidden from view)
Figure 4B:
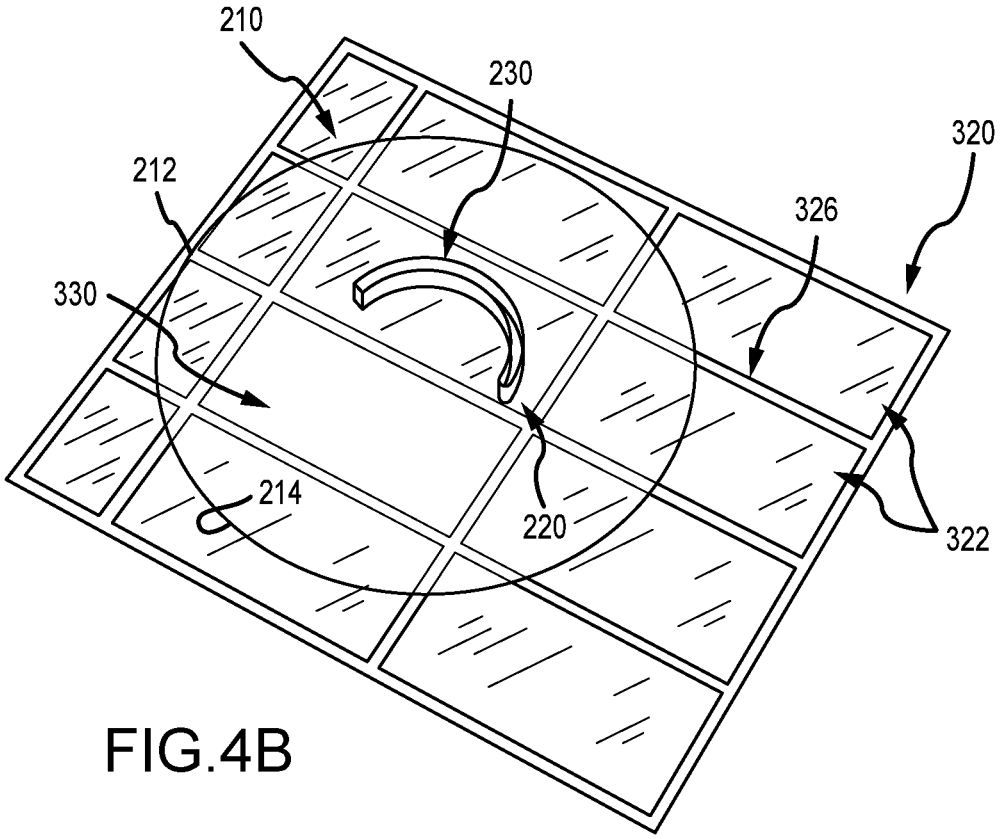

FIGS. 4A and 4B are top perspective views of an assembly of the ceiling/surface 320 and the slotted disk 210 providing, respectively, a conventional view and a transparent-disk view. In FIGS. 4A and 4B, the disk 210 is in a first or starting position in which the slot 220 is positioned behind one of the physical panels 322 of the ceiling/surface 320. Hence, in this first or starting position for the disk 210, the existence of the slot 220 and of the viewing window/hole 330 is hidden from view of an observer in the space below or defined by the surface/ceiling 320. A solid or uncut portion (e.g., half of the disk 210 or the like) of the projection or bottom surface 214 of the disk 210 is in fact positioned over the window or hole 330 blocking the view of the space above or behind the ceiling or surface 320.

Figure 5:
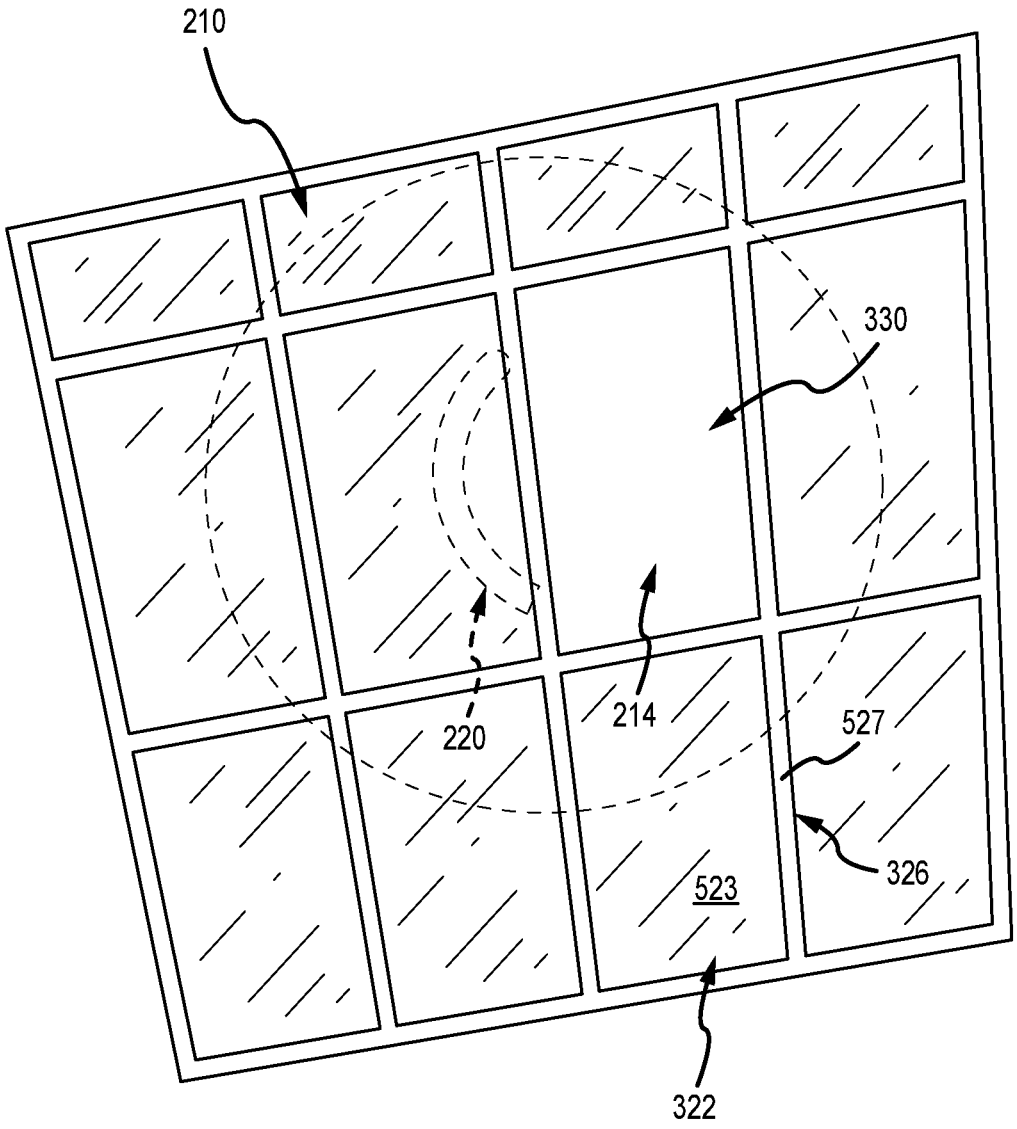
FIG. 5 is a bottom perspective of the ceiling and slotted-disk assembly of FIG. 4A showing exposed surfaces of the components with the disk in the first or starting position (and showing projection surfaces for the video projector of the special effects system)

FIG. 5 is a bottom perspective of the assembly of the ceiling/surface 320 and the slotted disk 210 of FIG. 4A showing exposed surfaces of the components with the disk 210 in the first or starting position. FIG. 5 shows projection surfaces 214, 523, and 527 of the disk 210, the panels 322, and the mullions 326, respectively, for a video projector of the special effects system. In this first or starting position of the disk, the bottom or projection surface 214 of the disk 210 appears to be a normal ceiling panel 322 when viewed from below. The disk 210 is positioned to be parallel to the panels 322 and, hence, surface 320 and, typically, only a small distance away (e.g., 0.125 to 0.25 inches or the like) to avoid rubbing during rotation of the disk 210 during system operations while providing the surface 214 of the disk 210 in a plane that nearly coincides with the lower surfaces of the panels 322 to hide the presence of the disk 210.

Figure 6:
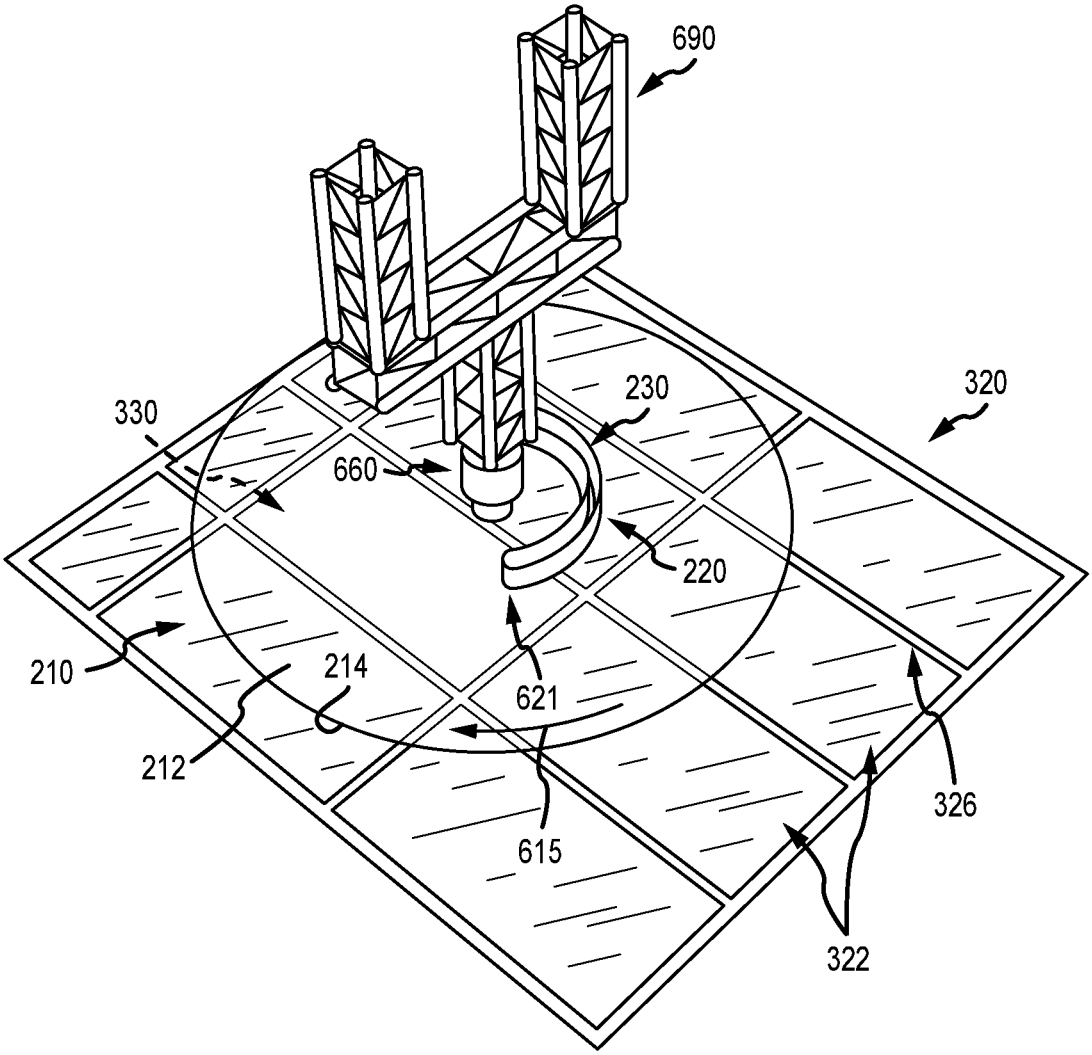
FIG. 6 is a top perspective view of the ceiling and slotted-disk assembly of FIGS. 4A-5 with the addition of a support frame and disk-rotating motor and with the motor operating to rotate the disk into a second or intermediate position in which the leading edge of the slot is moved over the viewing window/hole in the ceiling so as to be in view of an observer.

FIG. 6 is a top perspective view of the assembly of the ceiling/surface 320 and the slotted disk 210 of FIGS. 4A-5 with the addition of a support frame 690 and a disk-rotating motor 660. The motor 660 is attached at its output to the center of the back surface/side 212 of the disk 210. When operated, the motor 660 rotates the disk 210 as shown with arrow 615 (about its central axis at a desired rate of 1 to 10 RPM or faster with 5 RPM used in one useful implementation) into a second or intermediate position in which the leading edge 621 of the slot 620 is moved (and moving with disk 210) over the viewing window/hole 330 in the ceiling/surface 320 so as to be in view of an observer looking up at the ceiling/surface 320.

Figure 7:
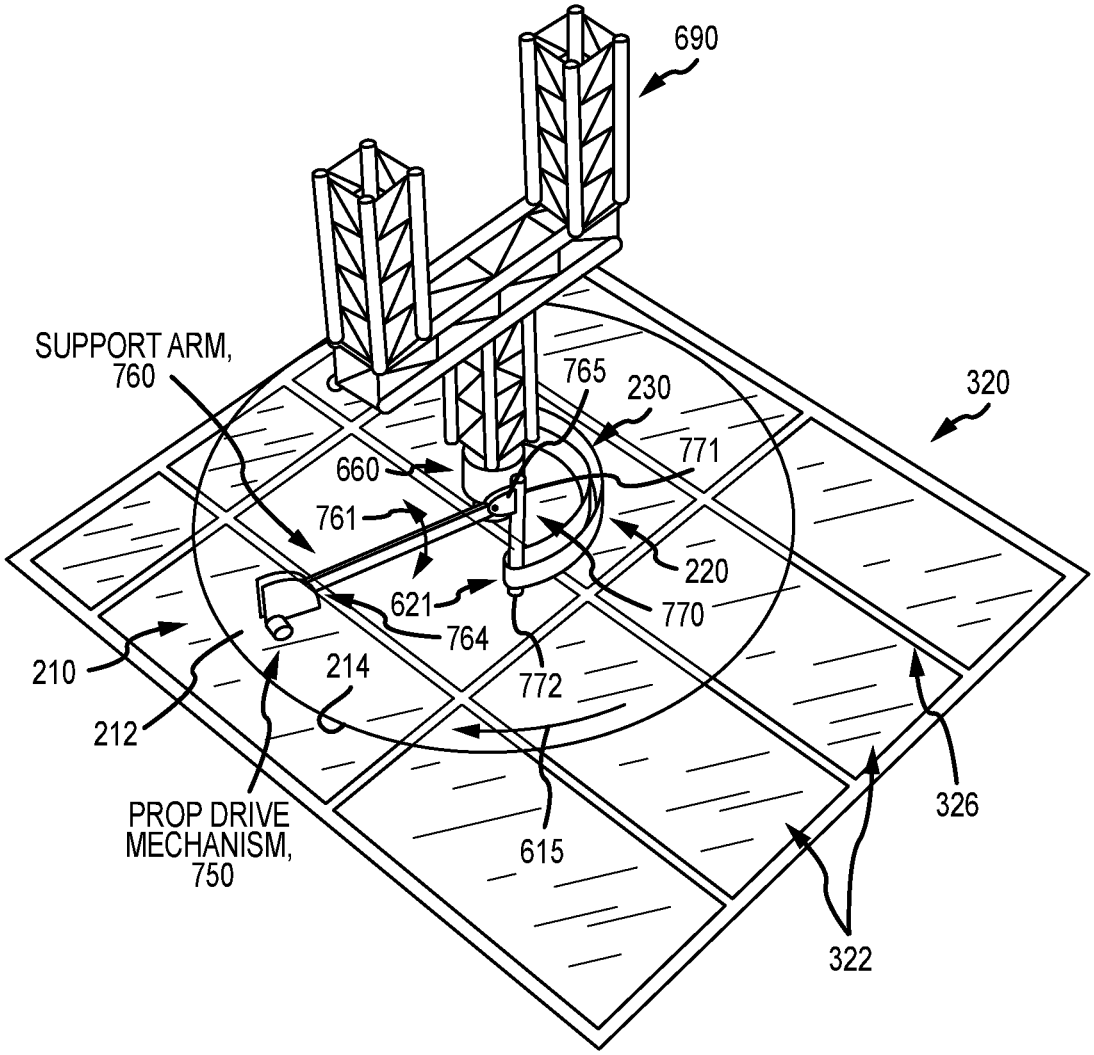
FIG. 7 is a top perspective view similar to FIG. 6 but with the addition in the special effects system of a physical or 3D prop assembly mounted upon the back or top side of the disk to rotate with the disk.

FIG. 7 is a top perspective view similar to FIG. 6 but with the addition in the special effects system of a physical or 3D prop assembly mounted upon the back or top side 212 of the disk 210 to rotate with the disk 210 as shown with arrow 615. The prop assembly includes a prop drive mechanism 750 attached to the surface 212 of the disk 210 and defining a pivot point for a support arm 760. Particularly, the arm 760 is coupled with the drive mechanism 750 at a first end and caused, during operations of the drive mechanism 750, to pivot up and down as shown with arrow 761. This causes the opposite end 765 of the arm 760 to travel along a throw path or travel path, too, and the end 765 of attached to an upper end 771 of the prop or prop body 770. In this example, the prop body 770 is an elongated cylinder or tube with a second end 772 extending into and out of the slot 220. Typically, the end 771 is rigidly affixed to the arm end 765 such as at an angle in the range of 75 to 90 degrees or the like (e.g., to be vertical relative to the surface 320 or at a somewhat smaller angular orientation). The throw or travel path of the end 765 and prop 770 is chosen to achieve a desired amount of extension of the prop 770 into the space below the disk 210 (e.g., may be in the range of 12 to 24 inches or more).

During operations of the system, the arm 760 with the faux saber or prop 770 attached teeters 761 up and down (with drive mechanism 750 being programmed for slow back and forth motion during rotation 615 of disk 210). From below the surface 320, the saber/prop 770, which is positioned to be at or near the leading edge 621 of the slot 220, appears to be cutting a curved slot as the disk 210 rotates in response to operations of motor 660 as shown by arrow 615. Since the drive mechanism 750 is moving with the disk 210, the prop 770 moves, too, and remains at the leading edge 621 of the slot 220 (which is also moving with the disk 210).

Figure 8:
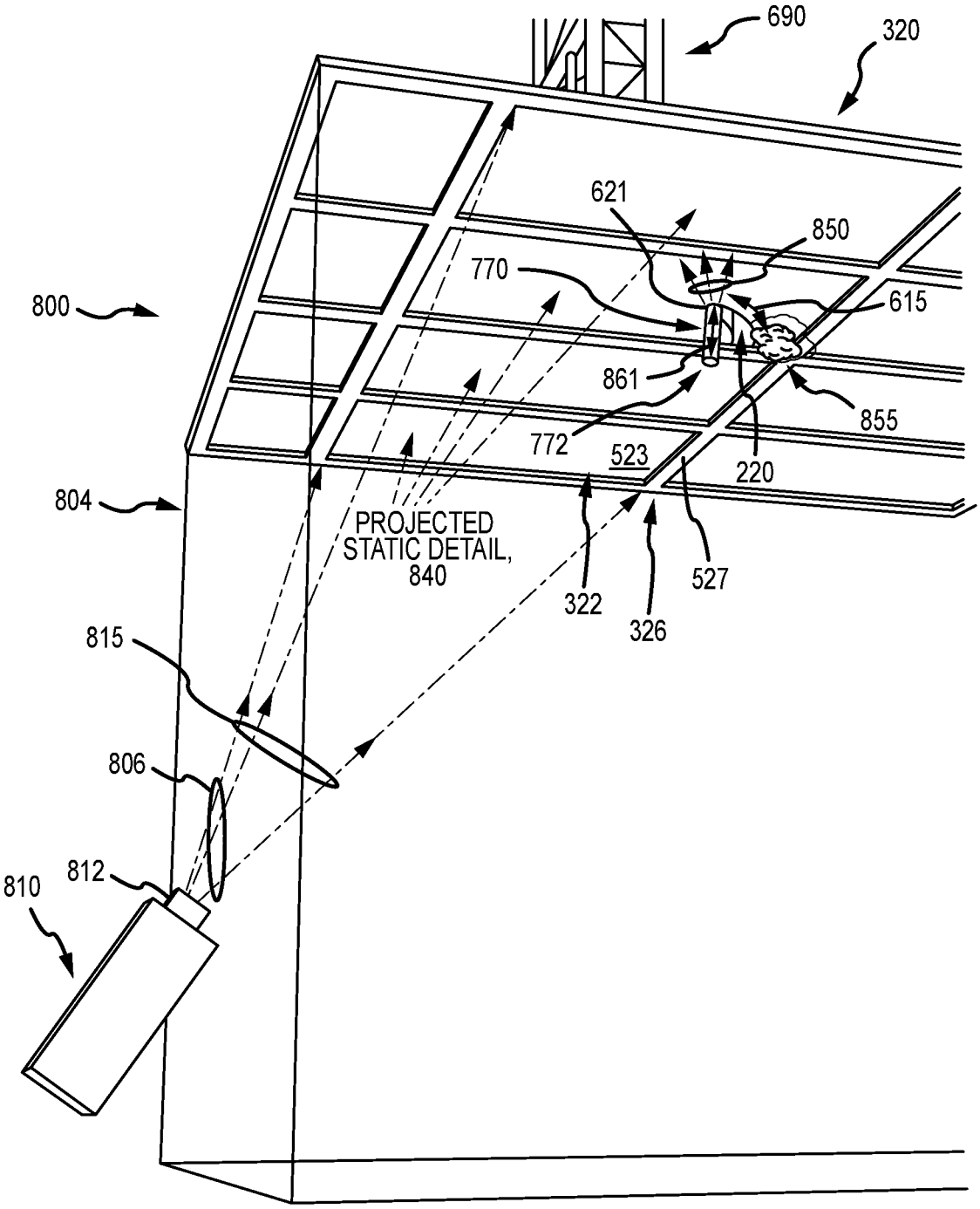
FIG. 8 is a bottom perspective of the complete and operating special effect system of FIGS. 2-7 further showing operations of a video projector to project static image effects and dynamic image effects upon the projection or bottom surfaces of the panels and mullions of the ceiling as well as upon the rotating slotted disk.

FIG. 8 is a bottom perspective of the complete and operating special effect effects system 800 of FIGS. 2-7 further showing operations of a video projector 810 to project static image effects and dynamic image effects in output light 815. This light 815 is directed through a hole in a sidewall (second surface) 804 of the physical set of system 800, and the light 815 is mapped onto the projection or bottom surfaces 523 and 527 of the panels 322 and mullions 326 of the ceiling/surface 320 as well as upon the projection or bottom surface 214 of the rotating slotted disk 210. Particularly, static images in output or media 815 from the projector 810 are projected onto the surfaces 623 and 214 surfaces of the panel 322 and disk 210 while the disk 210 rotates 615 to place the slot 220 over the window/hole 330 in the surface/ceiling 320.

As shown, the end 772 of the prop 770 moves up and down as shown by arrows 861 in a cutting motion as it and the leading edge 621 of the slot 220 are moved into view (over the hole/window 330 in the ceiling/surface 320). The output light/media 815 also includes dynamic image effects, and these may take the form of puffs of smoke 855 with drop shadows that are displayed at the leading edge 621 of the slot 220 or along the trailing edges of the slot 220. The dynamic effects in media/light 815 may also include flames or glowing surfaces on or near the edges of the slot 220, which makes it appear as if the prop 770 is burning its way through the ceiling/surface 320. The system 800 may further include light sources (e.g., LEDs) in the slot 220 or nearby (e.g., on inner surfaces of the depth-providing wall) that are operated to enhance the cutting illusion by providing intermittent or twinkling lights as shown by arrows 850 in FIG. 8 near the leading edge 621 so as to move with the rotating disk 210 and the slot 220 contained therein.

From FIG. 8, it can be seen that in order to disguise the fact that the disk is rotation rotating the video projector can be used to project media from below of static ceiling detail on the surface of the moving disk. As the disk rotates, the projected media is still and fools the eye into thinking that the surface of the disk is not moving. When viewed from below, the protruding prop (e.g., light saber) at the leading edge of the cut or slot with its up and down motion and the gradual reveal of the slot as the disk rotates act, together with the projected static media, to create the illusion that the prop or saber is cutting a curved slot in what appears to the viewer to be a normal ceiling panel. In addition to the static surfaces detail, the video projector also projects media of a glowing edge and smoke, in some implementations, with a drop shadow all along the edge of the slot as the slot moves further into the window/hole provided by the missing panel. This makes it appear as though the prop or light saber is burning through the disk.

Figure 9:
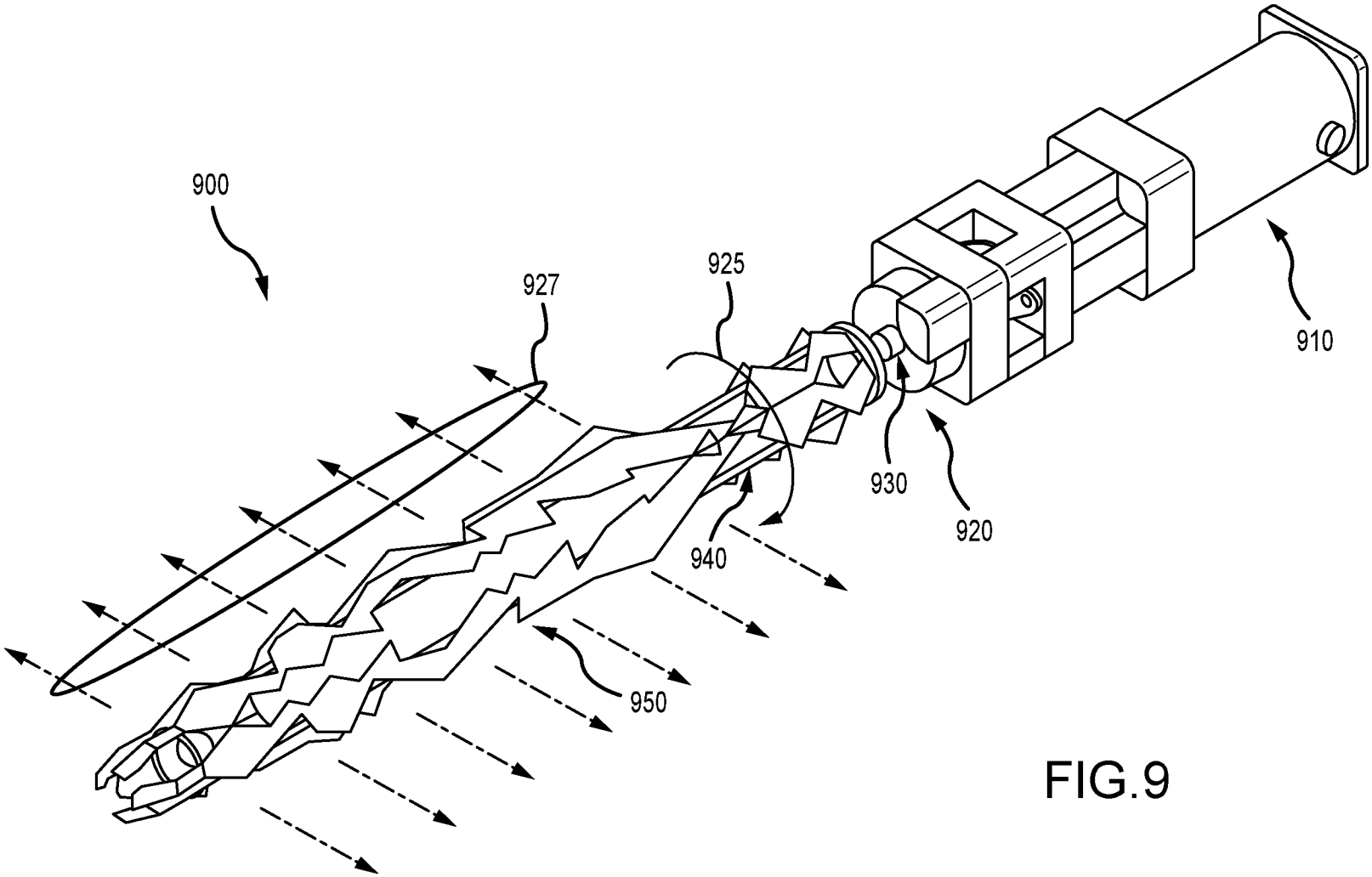
FIG. 9 is a perspective view of an exemplary physical or 3D prop, in the form of a rotating energy sword or light saber, for use in a pivoting physical prop assembly of the special effects system of the present description.
Figure 10:
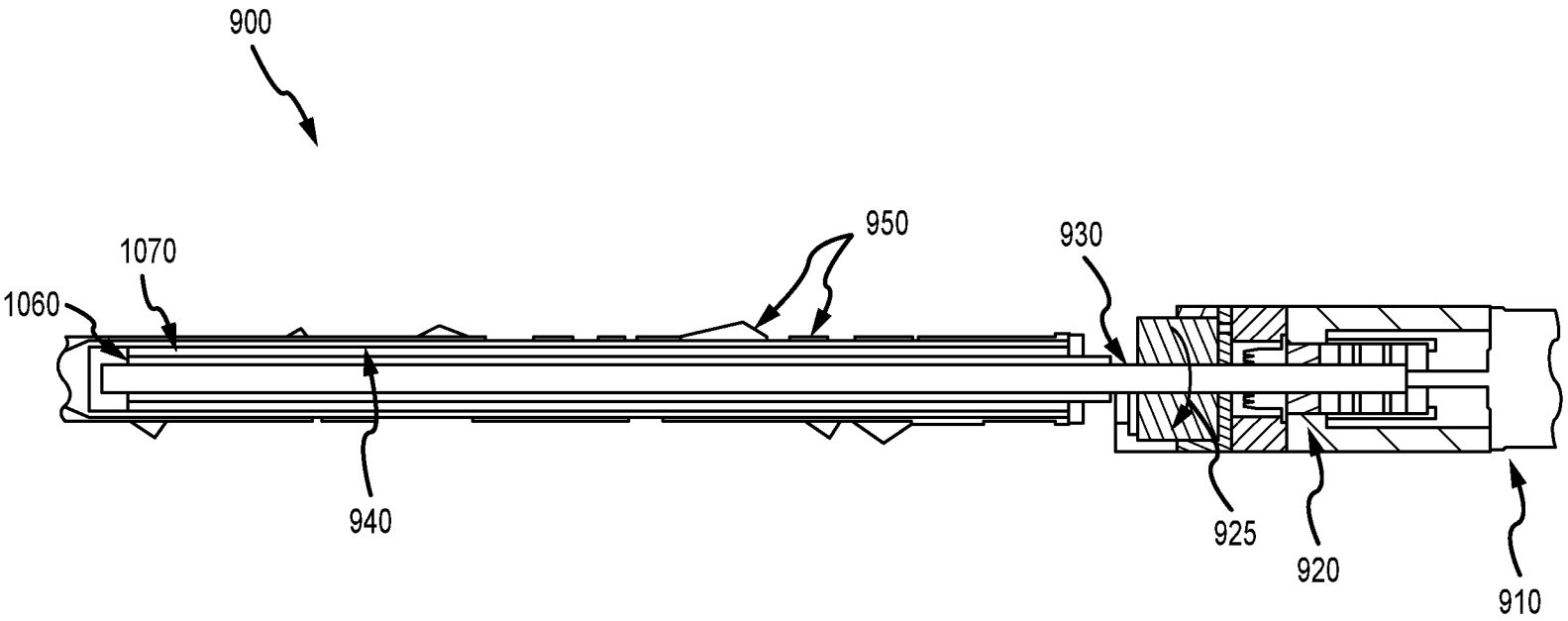
FIG. 10 is a side sectional view of the energy sword prop of FIG. 9.

FIG. 9 is a perspective view of an exemplary physical or 3D prop 900, in the form of a rotating energy sword or light saber, for use in a pivoting physical prop assembly of the special effects system of the present description (e.g., in FIG. 1 or FIG. 7). FIG. 10 is a side sectional view of the energy sword prop 900 of FIG. 9. As discussed with reference to FIG. 1 and the moving prop assembly 1170, it is useful in some implementations of a special effects system providing a cutting surface illusion to provide a physical prop in the special effect system to provide a physical or 3D object that a viewer links to the cutting action. By having the prop move relative to the projection surface of the rotating disk, it appears to more clearly be acting or active in cutting the material of the disk. To further show to the viewer that the prop is not simply projected, it is useful to have the prop be self-illuminating and, often, with a brightness that exceeds that of the projected light on the screen element to cause the prop to appear to itself be energized, hot, and/or on fire. Further, it is useful to animate this onboard lighting and, in some cases, to animate the prop itself with onboard or local moving components (e.g., move the whole prop relative to the rotating disk with the sawing motion and then also have the prop itself having moving parts), which reinforces to the observer that the prop is physical and not merely projected.

These features may be added in a number of ways to practice the special effects system, but it may be useful to describe one useful embodiment of a prop that is configured to provide bright output lighting and to animate itself with onboard moving components. FIGS. 9 and 10 illustrate a physical prop 900 in the form of a light saber or energy sword that can be supported in an effects system (as discussed above) on a screen element so it appears to be moved by the displayed character. This may be achieved by mounting the hilt or handle 910 to a mechanical arm and having the elongated body of the prop 900 extending outward from the projection surface toward the viewing space.

To provide onboard movement or animation, the prop 900 includes an electric motor 920 in the hilt/handle 910 that is coupled to an end of an inner tube or rod 930. The inner tube or rod 930 is caused to rotate about its longitudinal or central axis as shown with arrow 925 during operations of the motor 920 (and the special effects system in which the prop 900 is provided). The inner tube 930 acts as a support for the lighting assembly components used to achieve a lighting effect, and, as a result, the whole body of the prop 900 is animated with a spinning or rotating motion that can readily be observed by a viewer in the viewing space so as to reinforce the physicality of the prop 900. The inner tube or rod 930 has a length in the range of 12 to 36 inches (or more) as does the body (assembly of components extending outward from the hilt/handle 910) of the prop 900.

To provide a unique flame or glowing light effect, the prop includes one, two, or more strips of light sources (e.g., LEDs) 1060, which may be white or colored, that are spaced apart about the circumference of the inner tube 930 and that extend along the length of the inner tube. In one embodiment, a single row LED strip light that was 10 mm wide was used for four spaced-apart strips of light sources 960. When operated, the light source strips or arrays 960 output a bright light 927 in a direction away from the inner tube 930, and the spinning 925 caused the entire body of the prop to appear to be on fire or glowing (e.g., hides the presence of individual strip lights). To this end, the spinning rate is preferably above a predefined minimum, such as 100 to 150 RPM or higher, to disguise the presence of the light sources 1060.

The onboard lighting assembly of the prop 900 further includes a diffusion layer 1070 over the light source strips 1060. In one case, the diffusion layer 1070 was formed from a sheet of lenticular diffusion material. The diffusion layer 1070 is provided to make each of the strips of light sources 1060 appear optically to be an uninterrupted line of bright light. The light strips 1060 may be powered while rotating from a slip ring in the handle 910 (e.g., a slip ring giving 24V during rotation 925).

To make a jagged random edge (which may be desirable in some cases but not required to implement the prop 900), cut up fins of a flexible material (such as China silk (that may be white)) that are aligned with the light source strips 1060 may be used. In the embodiment shown, though, an outer tube 940 is provided over the diffuser layer 1070 (and connected at its ends to the inner tube 930), and an outer coating 950 is provided (e.g., a cast silicone or the like) on the outer surfaces of the outer tube 940. The outer coating 950 and tube 940 are formed of material that is translucent-to-transparent to the light from the sources 1060. The outer coating is randomly "sliced" to have an irregular and jagged (with peaks and valleys) texture to give it a randomized sharp-looking edge when spinning. During use of the prop 900, the motor 920 turns the inner tube or shaft 930 so as to cause the whole assembly described above to turn. Through persistence of vision, the prop 900 appears to have a tube extending out from the handle/hilt 910 that has a very hot center and flaming edges.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A system for providing a surface cutting special effect, comprising:

a physical set with a surface defining a space that is adjacent to a viewing space, wherein the surface comprises a plurality of panels each with a projection surface facing the space;

a viewing window provided in the surface in place of one of the panels;

a disk with a first surface facing toward the space and with a second surface facing away from the space, wherein the disk is positioned to be parallel to a plane containing the panels;

a slot extending through the disk from the first surface to the second surface;

a motor with an output coupled to a center portion of the disk on the second surface of the disk, wherein the motor is operable to rotate the disk about its center from a first position with a portion of the disk free of the slot being positioned over the viewing window to a second position with a portion of the disk containing the slot being positioned over the viewing window; and a pivoting physical prop assembly with a drive mechanism mounted to the second surface of the disk, with a support arm coupled at a first end to the drive mechanism, and with a physical prop coupled to a second end of the support arm, wherein the physical prop has an elongated body, wherein the support arm is driven during operations of the drive mechanism to pivot through a travel path that causes the body of the physical prop to move in and out of the slot to extend from the first surface a predefined distance.

2. The system of claim 1, wherein the motor and the drive mechanism are operated concurrently.

3. The system of claim 1, further comprising a video projector projecting light providing matching static images onto the first surface of the disk and onto the projection surfaces of the panels, wherein the static images are media mapped to the locations of the first surface of the disk and to the projection surfaces of the panels.

4. The system of claim 3, wherein the video projector further operates to project light providing dynamic images onto the first surface of the disk that are media mapped to locations of the slot during operations of the motor to rotate the disk.

5. The system of claim 4, wherein the dynamic images comprise smoke with drop shadows, flames, or glowing areas.

6. The system of claim 1, further comprising a lighting assembly with light sources positioned in or near a leading edge of the slot and adapted to output light on an intermittent basis, whereby the leading edge is illuminated with flashes of light.

7. The system of claim 1, wherein the body of the physical prop houses a lighting assembly operating during the operating time period to illuminate the body and wherein the physical prop further includes a drive element operating during the operating time period to rotate the body about a longitudinal axis.

8. The system of claim 7, wherein the drive element comprises an electric motor, wherein the body comprises: (a) a central tube coupled to the electric motor for rotation about the longitudinal axis; (b) at least one strip of light emitting diodes (LEDs) extending along an outer surface of the central tube; and (c) a layer of diffusing material over the at least one strip of LEDs.

9. The system of claim 1, wherein the disk is circular in shape and wherein the slot is semicircular in shape.

10. The system of claim 9, wherein the disk has an outer diameter selected such that the first surface of the disk covers an entire area of the viewing window with the disk in the first position and in the second position.

11. A system for providing a surface cutting special effect, comprising:

a ceiling with a lower surface facing a space and with a hole provided therethrough;

a disk positioned parallel to an upper surface of the ceiling and with a first surface facing toward the space and with a second surface facing away from the space;

a semicircular slot extending through the disk from the first surface to the second surface;

a motor with an output coupled to the second surface of the disk, wherein the motor is operable to rotate the disk about its center from a first position with a solid portion of the disk being positioned over the hole to a second position with a portion of the disk containing the slot being positioned over the hole; and a prop assembly with an elongated prop positionable in the slot near a leading edge of the slot and a drive mechanism, wherein the drive mechanism is mounted to the second surface of the disk and wherein during operations of the drive mechanism the prop is driven in a reciprocating manner to extend between a first position with an end of the prop in or near the slot and a second position with the end of the prop spaced apart some distance from the first surface of the disk.

12. The system of claim 11, further comprising a video projector projecting light providing matching static images onto the first surface of the disk and onto the projection surfaces of the panels, wherein the static images are media mapped to the locations of the first surface of the disk and to the projection surfaces of the panels.

13. The system of claim 12, wherein the video projector further operates to project light providing dynamic images onto the first surface of the disk that are media mapped to locations of the slot during operations of the motor to rotate the disk.

14. The system of claim 13, wherein the dynamic images comprise smoke with drop shadows, flames, or glowing areas.

15. The system of claim 11, further comprising a lighting assembly with light sources positioned in or near a leading edge of the slot and adapted to output light on an intermittent basis, whereby the leading edge is illuminated with flashes of light.

16. The system of claim 11, wherein a body of the prop houses a lighting assembly operating during the operating time period to illuminate the body and wherein the prop further includes a drive element operating during the operating time period to rotate the body about a longitudinal axis.

17. The system of claim 16, wherein the drive mechanism comprises an electric motor and wherein the body comprises: (a) a central tube coupled to the electric motor for rotation about the longitudinal axis; (b) at least one strip of light emitting diodes (LEDs) extending along an outer surface of the central tube; and (c) a layer of diffusing material over the at least one strip of LEDs.

18. The system of claim 11, wherein the disk is circular in shape.

19. A method of generating a ceiling cutting special effect, comprising:

projecting video onto a ceiling surface and a projection surface of a rotatable disk exposed via a viewing window in the ceiling surface, wherein the video includes static images that are media mapped to predefined portions of the ceiling surface and the projection surface;

rotating the rotatable disk from a first position to a second position during the projecting, wherein the rotatable disk comprises a semicircular slot and wherein a first portion of the rotatable disk is located over the viewing window with the rotatable disk in the first position and second portion of the rotatable disk containing the semicircular slot is located over the viewing window with the rotatable disk in the second position; and during the rotating, moving an elongated body with a reciprocating motion through the slot near a leading edge of the slot to alternate over time from having an end a first distance from the projection surface of the rotatable disk and having the end a second distance, differing from the first distance, from the projection surface.

20. The method of claim 19, wherein the video includes dynamic images that are mapped to portions of the projection surface of the rotatable disk proximate to the slot and further comprising rotating the elongated body during the moving of the elongated body and illuminating at least one of the elongated body and the leading edge of the slot with one or more light sources.

* * * * *